United States Patent [19]

Parks

[11] Patent Number: 5,073,135

[45] Date of Patent: Dec. 17, 1991

[54] BUOYANT MARKER

[76] Inventor: Raymond Parks, Rte. 1, Box 85, Porter, Okla. 74454

[21] Appl. No.: 583,338

[22] Filed: Sep. 17, 1990

[51] Int. Cl.[5] ..... B63B 21/52

[52] U.S. Cl. ..... 441/6; 441/26

[58] Field of Search ..... 441/1, 6, 11, 21, 23, 441/24, 26, 28, 32, 33, 34; 220/475, 560

[56] References Cited

U.S. PATENT DOCUMENTS

| | | | |
|---|---|---|---|
| 946,174 | 1/1910 | Vroman et al. . | |
| 1,049,563 | 1/1913 | Christiansen | 441/34 |
| 1,226,905 | 5/1917 | Newmann | 441/34 |
| 2,675,776 | 4/1954 | Tuve | 441/6 |
| 2,977,608 | 4/1961 | Brown et al. . | |
| 3,653,085 | 4/1972 | Rovner | 9/8 |
| 3,698,025 | 10/1972 | Worobel | 9/8.3 |
| 4,443,203 | 4/1984 | Maertens | 441/22 |
| 4,501,563 | 2/1985 | Johnson et al. | 441/6 |
| 4,544,364 | 10/1985 | Bankston | 441/6 |
| 4,601,126 | 7/1986 | Klocksiem | 43/17.5 |
| 4,858,369 | 8/1989 | Collins | 441/6 |

*Primary Examiner*—Jesus D. Sotelo
*Assistant Examiner*—Stephen P. Avila
*Attorney, Agent, or Firm*—Staas & Halsey

[57] ABSTRACT

A device includes two enlarged end portions joined by a medial portion. It serves as a light-weight sturdy plastic container for motor oil or as buoyant marker for marking areas in a body of water where fish have been located. After the oil is used, fishing line is wrapped around the medial portion of the container and a weight is attached to the free end of the fishing line. The emptied container is thrown into the body of water, the line unravels and the weight sinks to the bottom. This allows the floating container to maintain its position. Alternatively, a fishing hook can be attached to the end of the line.

7 Claims, 2 Drawing Sheets

BUOYANT MARKER

BACKGROUND OF THE INVENTION

1. Field of the Invention

The invention is directed to a buoy and, more particularly, to a device for marking areas on a body of water where fish are located, and for containing a fluid, such as motor oil.

2. Description of the Related Art

There are many different types of buoyant markers on the market. The markers, however, add only to the number of objects that need to be packed and stored on board a boat. The buoyant markers take up space and are not useful for any other purpose except for marking areas on a body of water, such as where fish have been located.

SUMMARY OF THE INVENTION

Accordingly, it is an object of the present invention to provide a buoyant marker which is useful for a number of different purposes, not only as a marker.

It is another object of the present invention to provide a buoyant marker which can be used as an oil container, as a marker for where fish are present in a body of water, or as a fishing line holder.

It is yet another embodiment of the present invention to provide a combination buoyant marker/container which is durable and economical.

To achieve the foregoing and other objects of the present invention, there is provided a container for fluid. The fluid can be, for example, outboard motor oil, or other types of oil. The container has a medial portion, two enlarged opposite end portions and a cap located on one end of the two enlarged opposite end portions. The medial portion and the two enlarged opposite ends form a continuous interior and define a spool-like shaped container. A line is wound around the medial portion of the bottle. A weight or fish hook is provided at one end of the line.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Figure 1:
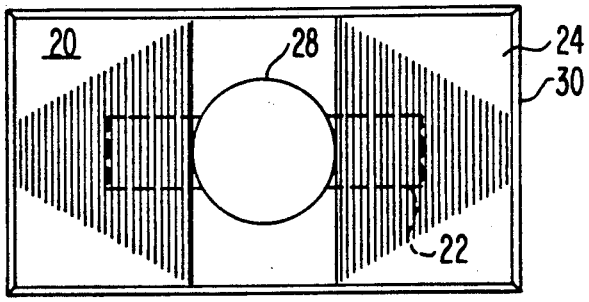
FIG. 1 is a top view of a buoyant marker according to the present invention.

FIGS. 1-5 illustrate a buoyant marker, indicated generally by reference numeral 20, according to the present invention. The buoyant marker 20 is a rigid container having a medial portion 22 between first and second enlarged opposite end portions 24 and 26, and a threaded cap receptacle 28 located on the first end portion 24 for receiving a threaded closure cap 29 (FIG. 1). The medial portion 22 and the two enlarged opposite end portions 24 and 26 form a spool-like shaped container.

Bevels 30 can be formed on the edges of the first and second enlarged end portions 24 and 26, during manufacture of the buoyant marker 20. The bevels 30 can be, for example, 1/16th of an inch deep. The bevels 30 improve rigidness of the buoyant marker 20 so that it is not easily collapsible. The bevels 30 also add to the visual distinctiveness of the buoyant marker.

Although a particular shape of the device is shown in the drawings, it is to be understood that many shapes could be used which would also satisfy the inventor's objective of being able to hold fluid and act as a buoyant marker. For example, the device could be barbell shaped.

The buoyant marker 20 is preferably made of a light weight durable material such as plastic. The buoyant marker 20 is compact in size and is easily storable, e.g., under the seat of a boat.

The buoyant marker 20 can store outboard motor oil, regular oil, or any desired fluid that might be taken or used with a boat. It is most economical and efficient if a fluid that must necessarily be carried on board the motor boat is stored in the container 20, such as outboard engine oil.

After using the fluid stored in the buoyant marker 20, for example, the outboard motor oil, the buoyant marker 20 can be used in its marker capacity. Therefore, rather than bringing aboard a can or bottle of outboard motor boat oil and a separate buoyant marker, only the buoyant marker 20 of the present invention need be brought aboard for both purposes. Most particularly, it is contemplated that producers/distributors of oil would package their oil in the buoyant marker 20 for sale at, e.g., boat supply stores. A customer would purchase the buoyant marker 20, use up the oil and then have a buoyant marker available for use.

Figure 4:
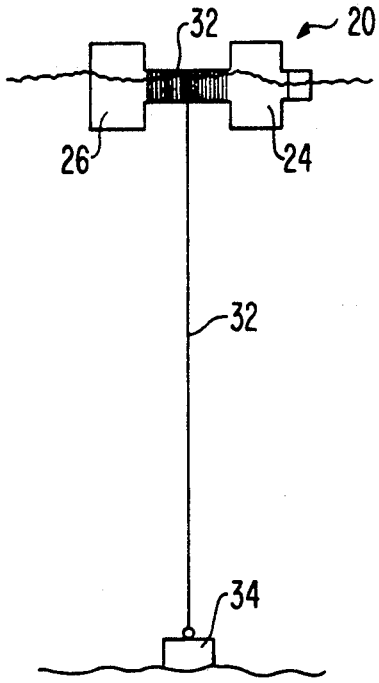
FIG. 4 is a view of the buoyant marker used to mark a particular spot in a body of water.

More particularly, as shown in FIG. 4, line 32 is wrapped around the medial portion 22 between the first and second enlarged end portions 24 and 26 of the buoyant marker 20. The line 32 can be, for example, fishing line. At the free end of the line 32, a weight 34 is attached. The buoyant marker 20 is thrown into a body of water, the weight 34 sinks, turning the buoyant marker 20 and unravelling the fishing line 32 until the weight 34 reaches the bottom of the body of water. The buoyant marker 20 remains stationary, that is, it will not deviate substantially from where it has been placed in the body of water. The spool-like shape of the container 20 allows it to float, thus acting as a buoyant marker. One can then leave the area where fish have been spotted and come back later since the area is now marked by the buoyant marker 20 of the present invention.

Figure 5:
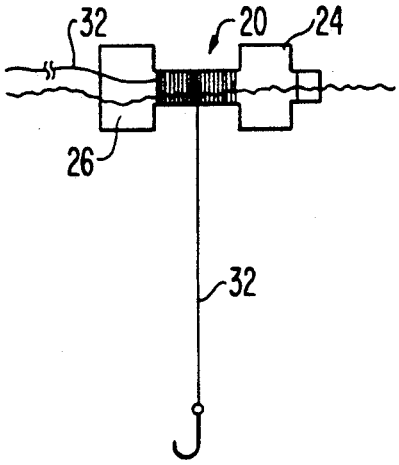
FIG. 5 is a view of the buoyant marker used as a fishing line holder.
Figure 2:
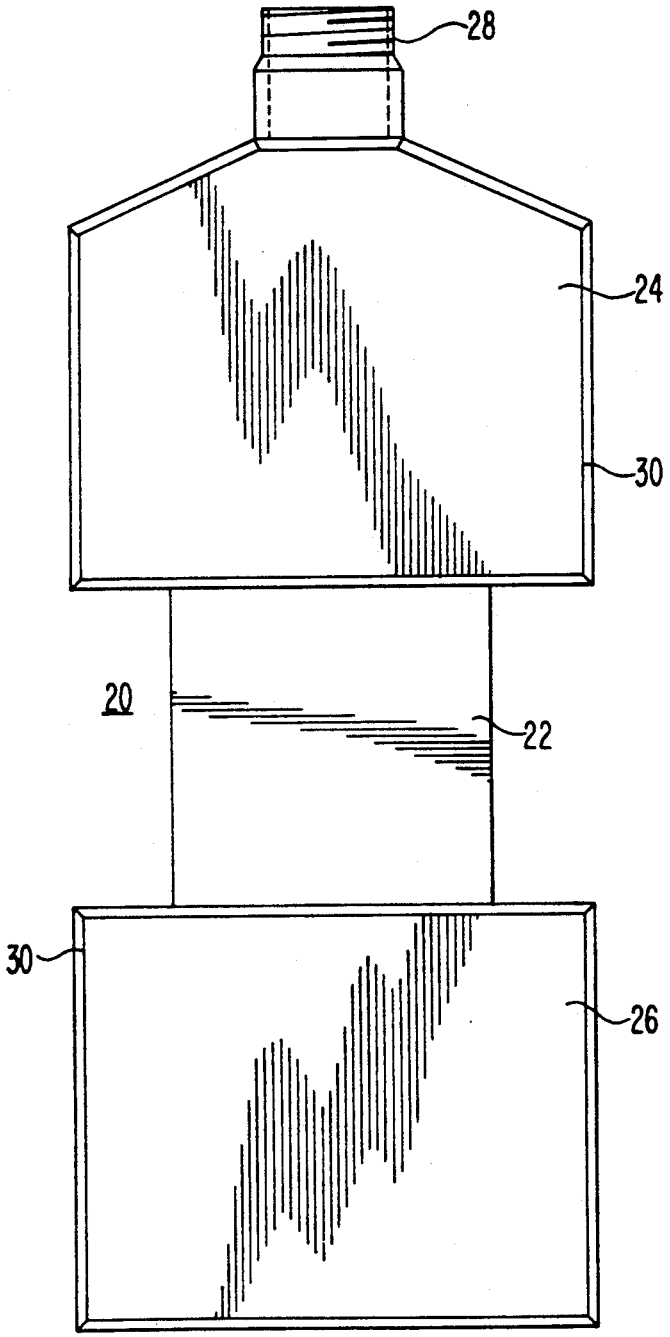
FIG. 2 is a front view of the buoyant marker.
Figure 3:
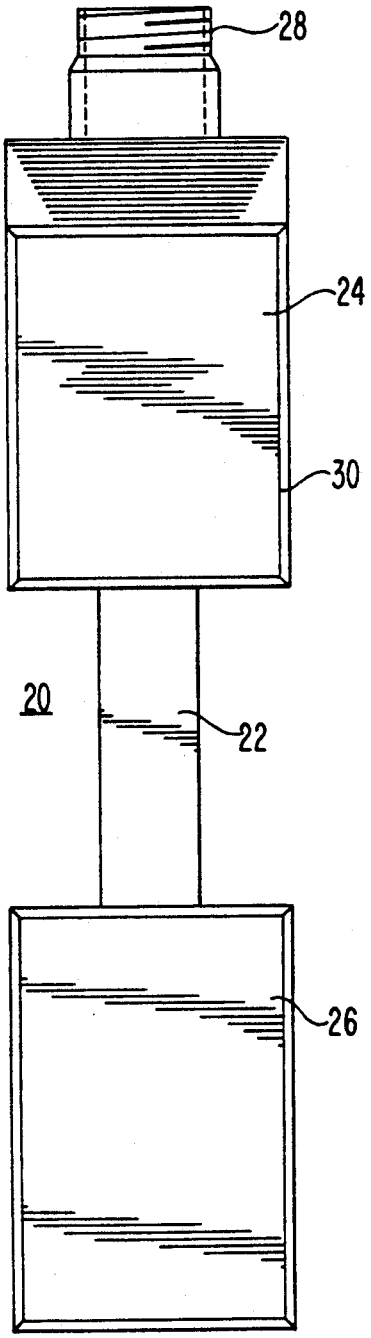
FIG. 3 is a side view of the buoyant marker.

In another embodiment of the present invention shown in FIG. 5, a hook 36 can be attached to the free end of the line 32, the line 32 being again, for example, fishing line. The fishing line 32 is let out to a predetermined length. A knot is then tied at the portion of the fishing line closest to the medial portion 22 of the buoyant marker 20. The fishing line 32 is then rewound and the hook is baited. When an area in which fish are located 10 is discovered, the buoyant marker 20 (one or more) is thrown into the water. The fishing line 32 unwinds to a predetermined depth set previously by the knot. This allows many separate fishing lines to be placed in an area where fish have been located.

It should be noted that any size buoyant marker 20 can be used. When outboard motor oil is stored, the buoyant marker may be small in size (i.e., one pint). When regular motor oil is stored, the buoyant marker may be larger in size (i.e., one quart).

The foregoing is considered as illustrative only of the principles of the invention. Further, since numerous modifications and changes will readily occur to those skilled in the art, it is not desired to limit the invention to the exact construction and application shown and described herein. Accordingly, all suitable modifications and equivalents may be resorted to, falling within the scope of the invention and the appended claims and their equivalents.

I claim:

1. A combination liquid container and air filled buoyant marker device, comprising:

a medial portion for receiving a line;

two enlarged opposite rectangular end portions on either side of said medial portion, said medial portion and said two enlarged opposite end portions defining a continuous, completely hollow interior for containing liquid, means including a neck and opening and being formed on the device for filling and emptying the device of liquid or air, wherein said opening is spaced by the neck from the device to facilitate pouring, wherein, when the device is filled with liquid, it serves as the fluid container, and wherein, when the device is filled with air, it serves as the buoyant marker.

2. The device according to claim 1, wherein said medial portion and said two enlarged opposite end portions define a spool-shaped container.

3. The device according to claim 1, wherein said line has a free end and an object is attached to said free end.

4. The device according to claim 3, wherein said object attached to said free end of said line comprises a weight.

5. The device according to claim 3, wherein said object attached to said free end of said line comprises a fish hook.

6. A buoyant marker according to claim 1, wherein said filling and emptying means includes a threaded cap receptacle for receiving a threaded closure cap.

7. The device according to claim 1, wherein said liquid comprises motor oil.

* * * * *